US008869884B2

(12) United States Patent
Telfer

(10) Patent No.: US 8,869,884 B2
(45) Date of Patent: Oct. 28, 2014

(54) DIVERTER CUP ASSEMBLY

(75) Inventor: George Telfer, Aberdeen (GB)

(73) Assignee: Specialised Petroleum Services Group Limited, Aberdeen, Aderdeenshire (GB)

( * ) Notice: Subject to any disclaimer, the term of this patent is extended or adjusted under 35 U.S.C. 154(b) by 570 days.

(21) Appl. No.: 13/144,447

(22) PCT Filed: Feb. 23, 2010

(86) PCT No.: PCT/GB2010/050307

§ 371 (c)(1),
(2), (4) Date: Sep. 2, 2011

(87) PCT Pub. No.: WO2010/097616

PCT Pub. Date: Sep. 2, 2010

(65) Prior Publication Data

US 2011/0308786 A1 Dec. 22, 2011

(30) Foreign Application Priority Data

Feb. 24, 2009 (GB) ..... 0903090.9

(51) Int. Cl.
*E21B 37/10* (2006.01)

(52) U.S. Cl.
CPC ..... *E21B 37/10* (2013.01)
USPC ..... 166/173; 166/99; 166/175

(58) Field of Classification Search
CPC ..... E21B 37/10; E21B 27/00
USPC ..... 166/99, 173, 175
See application file for complete search history.

(56) References Cited

U.S. PATENT DOCUMENTS

| | | | | | |
|---|---|---|---|---|---|
| 1,651,497 | A | * | 12/1927 | Wobermin | 417/511 |
| 2,135,167 | A | * | 11/1938 | Campbell | 417/511 |
| 2,221,427 | A | * | 11/1940 | Kinley | 417/284 |
| 2,334,788 | A | * | 11/1943 | O'Leary | 175/267 |
| 2,352,812 | A | | 7/1944 | Taylor | |
| 2,675,879 | A | * | 4/1954 | Middleton et al. | 166/99 |

(Continued)

FOREIGN PATENT DOCUMENTS

| | | | |
|---|---|---|---|
| GB | 2 335 687 | A | 9/1999 |
| WO | 2006/123109 | A1 | 11/2006 |

OTHER PUBLICATIONS

International Search Report issued in PCT/GB2010/050307, mailed on Sep. 7, 2010, 3 pages.

(Continued)

*Primary Examiner* — Giovanna Wright
(74) *Attorney, Agent, or Firm* — Osha Liang LLP

(57) ABSTRACT

A downhole cleaning tool for cleaning a casing is provided with a diverter cup assembly (102) including a housing (126) and a resilient swab cup (105) slidably mounted on a tubular body (120) with an increased external diameter portion 128 defining at either end upper and lower limit stops (130, 132), and sized to make provision for a gap (136) which allows a sliding movement of the swab cup such that only one of limit stops (130, 132) engages to always pull the swab cup via optional bearings (134) at each extremity of the sliding travel according to whether the tool is being run in hole or pulled out of the hole. This means that the swab cup is not compressed into a squat oversize shape susceptible to contact damage, and is naturally drawn out to tend towards an elongate shape in either direction of tool motion.

20 Claims, 4 Drawing Sheets

(56) References Cited

U.S. PATENT DOCUMENTS

| | | | | |
|---|---|---|---|---|
| 3,989,106 | A | 11/1976 | Taylor | |
| 4,921,046 | A | 5/1990 | Caskey | |
| 5,119,874 | A | 6/1992 | Ferguson et al. | |
| 7,500,526 | B2 | 3/2009 | Telfer | |
| 7,624,806 | B2 * | 12/2009 | Booth | 166/311 |
| 7,992,636 | B2 * | 8/2011 | Telfer | 166/99 |
| 2004/0089446 | A1 | 5/2004 | Sugden | |
| 2004/0112588 | A1 | 6/2004 | Mullins | |

OTHER PUBLICATIONS

Written Opinion issued in PCT/GB2010/050307, mailed on Sep. 7, 2010, 6 pages.

Search Report issued by the Intellectual Property Office of the UK mailed Jun. 22, 2009, 3 pages.

* cited by examiner

DIVERTER CUP ASSEMBLY

FIELD OF THE INVENTION

The present invention relate to a diverter cup assembly, and especially but not exclusively to a diverter cup assembly used as part of apparatus for cleaning the interior bore of well bore tubulars, such as found in the oil and gas production industries.

BACKGROUND TO THE INVENTION

When drilling for oil and gas, a wellbore or borehole of an oil or gas well is typically drilled from surface to a first depth and lined with a steel casing. The casing is located in the wellbore extending from a wellhead provided at surface or seabed level, and is then cemented in place. Following testing and other downhole procedures, the borehole is extended to a second depth and a further section of smaller diameter casing is installed and cemented in place. This process is repeated as necessary until the borehole has been extended to a location where it intersects a producing formation. Alternatively, a final section of tubing known as a liner may be located in the wellbore, extending from the lowermost casing section or casing 'shoe' to the producing formation, and is also cemented in place. The well is then completed by locating a string of production tubing extending from surface through the casing/liner to the producing formation. Well fluids are then recovered to surface through the production tubing.

However, before the well can be completed and well fluids recovered to surface, it is necessary to clean the lined wellbore and replace the fluids present in the wellbore with a completion fluid such as brine. The cleaning process serves, inter alia; to remove solids adhered to the wall of the casing or liner; to circulate residual drilling mud and other fluids out of the wellbore; and to filter out solids present in the wellbore fluid. Much of the solids present in the wellbore are found on the surface of the casing/liner, and may be rust particles and metal chips or scrapings originating from equipment used in the well and from the casing/liner itself.

For this purpose, well cleaning equipment is well known and comes in a variety of different forms, including casing scrapers, brushes and circulation fluid tools. Such equipment is used to free the well tubing from debris particles such as cement lumps, rocks, caked mud, and so on.

It is now common practice to run dedicated well cleaning apparatus after cementing the liner and prior to completion. Tools have also been provided in the art for incorporation in drill and the like work strings which are intended to perform a cleaning operation in wellbore completions.

During the extraction of conventional cleaning tools from the well, additional debris can be dislodged, such as from the wall of the casing, thereby undoing much of the cleaning work already performed.

The operation of such a tool can be understood from GB 2,335,687 (see FIG. 1) which describes a cleaning tool 1 for cleaning a casing 2, the cleaning tool 1 including a body, diversion means for diverting well fluid passing the tool 1 between a mandrel 4 and the exterior of the tool 1, and a filtration means comprising a filter 6 for filtering debris particles from at least some of the well fluid. When the cleaning tool 1 is pulled out of the wellbore, any dislodged debris falls into a diverter cup 5 at the top of the tool 1, and is diverted via bores 8 into a chamber 9 bounded by the mandrel 4 on the inside, the filter 6 on the outside and a one-way valve 12 at the lower end. Liquids can pass directly out of the filter 6, leaving the debris trapped in the chamber 9. For further details of the cleaning tool and the flowpaths operating when the tool is reciprocated, i.e. run in hole (RIH) and pulled out of hole (POH), see GB 2,335,687 the contents of which are hereby incorporated by reference.

FIG. 2 shows an enlarged view of the upper end of the FIG. 1 tool, which is only shown schematically in FIG. 1.

The diverter cup 5 is a resilient swab cup, with a concave-up orientation. The diverter cup 5 is mounted to the mandrel 4 via a tubular body 20, which is located concentrically around the mandrel 4 and which is connected to the mandrel 4 via screws 22. The heads of the screws 22 are received in an outer tubular 24, which overlies the lower end of the tubular body 20. The upper end of the filter 6 is received and supported between the outer tubular 24 and the tubular body 20.

The diverter cup 5 has a diverter cup housing 26 which encloses the lower end of the diverter cup 5 and mounts the diverter cup 5 to the tubular body 20 by retaining the lower end of the diverter cup 5 between itself and the tubular body 20. The diverter cup housing 26 has an inner diameter that matches the local outer diameter of the tubular body 20.

The tubular body 20 has an increased diameter portion 30, defining a limit stop 32 on a lower face thereof. The limit stop 32 is configured to engage the diverter cup housing 26, indirectly, via a bearing 34. An additional bearing 36 is located underneath the diverter cup housing 26, between the diverter cup housing 26 and the outer tubular 24.

The diverter cup 5 has a protective cap 28 on its upper end. The protective cap 28 is not connected to the tubular body 20 and does not mount the upper end of the diverter cap 5 on the tubular body 20. Instead, there is a flowpath around the cap 28, between the diverter cup 5 and the tubular body 20, to the inside of the tubular body 20 via bores 38 in the tubular body 20.

Whilst such a tool has gained wide approval in the field, it is considered that further improvements can be made.

It has been noted that when the downhole string is pulled out of the hole. The diverter cup 5 is effectively pushed out of the hole from its lower end, by the outer tubular 24 pushing on the bearing 36, pushing on the diverter cup housing 26, pushing on the lower end of the diverter cup 5. This pushing together with the "swiping" effect by contact within the hole causes the diverter cup 5 to "squat" or shorten to a wider profile, making it much more prone to damage by catching or snagging on any ledges in the hole. This means that in some cases the use of the tool has to be interrupted or delayed to return the tool to the workshop to restore operational capability. Whilst this is easily accomplished the associated downtime due to the re-dressing work and time lost in run-in and pullout represents a significant cost to the industry.

SUMMARY OF THE INVENTION

The improvements to be described in more detail hereinafter include a new assembly for mounting the diverter cup using separate housing parts slidable upon a tubular body and connected through the diverter cup itself, with associated limit stops on the tubular body acting upon the housing parts directly or indirectly through bearings to ensure that whenever the tool is run in the hole or pulled out the hole, the diverter cup is mainly subjected to pull forces tending to elongate it rather than push forces that would compress it to a squat shape as observed on pull out with the prior art tool. Furthermore, the new tool has attached thereto a protector component spaced from and separate from the slidable housing parts.

According to a first aspect of the present invention there is provided a diverter cup assembly comprising:

a tubular body having attachment means for attachment to a downhole string;

a diverter cup; and a diverter cup housing comprising upper and lower parts which retain the upper and lower ends of the diverter cup respectively, the diverter cup housing and the diverter cup being located concentrically around the tubular body and being slidably mounted on the tubular body between upper and lower limit stops; and wherein, in use in a well, the lower limit stop is configured to engage the lower part of the diverter cup housing when the downhole string is being run into the well, and the upper limit stop is configured to engage the upper part of the diverter cup housing when the downhole string is being pulled out of the well.

Optionally, the tubular body has an increased diameter portion defining a shoulder at each end thereof, the shoulders providing the upper and lower limit stops.

Typically, the upper part of the diverter cup housing co-operates with an outer face of the tubular body at a location above the upper limit stop and the lower part of the diverter cup housing co-operates with an outer face of the tubular body at a location below the lower limit stop.

Typically, the upper part of the diverter cup housing has a downwards-facing abutting face configured to engage the upper stop limit.

Typically, the lower part of the diverter cup housing has an upwards-facing abutting face configured to engage the lower stop limit.

Optionally, the abutting faces engage their respective upper and lower stop limits indirectly, via a respective bearing.

Optionally, the axial distance between the two abutting faces of the diverter cup housing is greater than the axial distance between the two limit stops.

Typically, only one of the abutting faces engages its respective stop limit at each extreme sliding position, a gap being present between the other of the abutting faces and its respective stop limit.

Optionally, the diverter cup has a larger diameter at its centre compared to at its upper and lower ends.

Typically, the tubular body includes at least one aperture located behind the diverter cup, to allow deformation of the diverter cup.

Optionally, the upper part of the diverter cup housing is formed in two parts which are releasably fastened together.

Typically, the diverter cup assembly also includes ports for passage of fluid into an annulus between the tubular body and the downhole string.

Optionally, at least some ports are provided in an upper end of the tubular body.

Optionally, at least some ports are provided on a separate member that is configured to connect to the upper end of the tubular body.

Typically, the separate member is a protective member, having a maximum outer diameter that is less than the maximum outer diameter of the diverter cup, but greater than the maximum outer diameter of the diverter cup housing.

According to a second aspect of the present invention there is provided a downhole string comprising a diverter cup assembly according to the first aspect of the invention.

Optionally, the downhole string comprises a cleaning tool for cleaning the interior bore of well bore tubulars, and the diverter cup assembly forms part of the cleaning tool.

Optionally, the cleaning tool comprises a cleaning tool body, diversion means for diverting well fluid passing the tool through the cleaning tool body, and a filtration means for filtering debris particles from at least some of the well fluid.

BRIEF DESCRIPTION OF THE DRAWINGS

An embodiment of the invention will now be described, by way of example only, and with reference to the following drawings, in which:—

MODE FOR CARRYING OUT THE INVENTION

Figure 1:
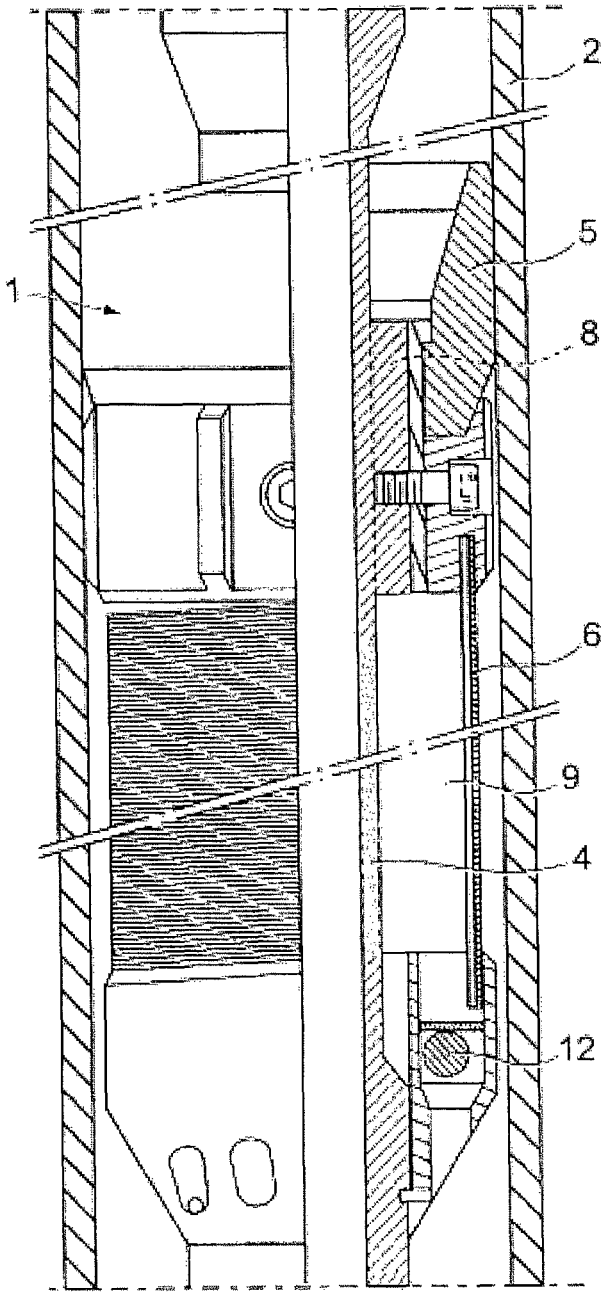
Fig. 1 PRIOR ART
FIG. 1 shows a schematic drawing of a prior art cleaning tool in use in a downhole string.
Figure 2:
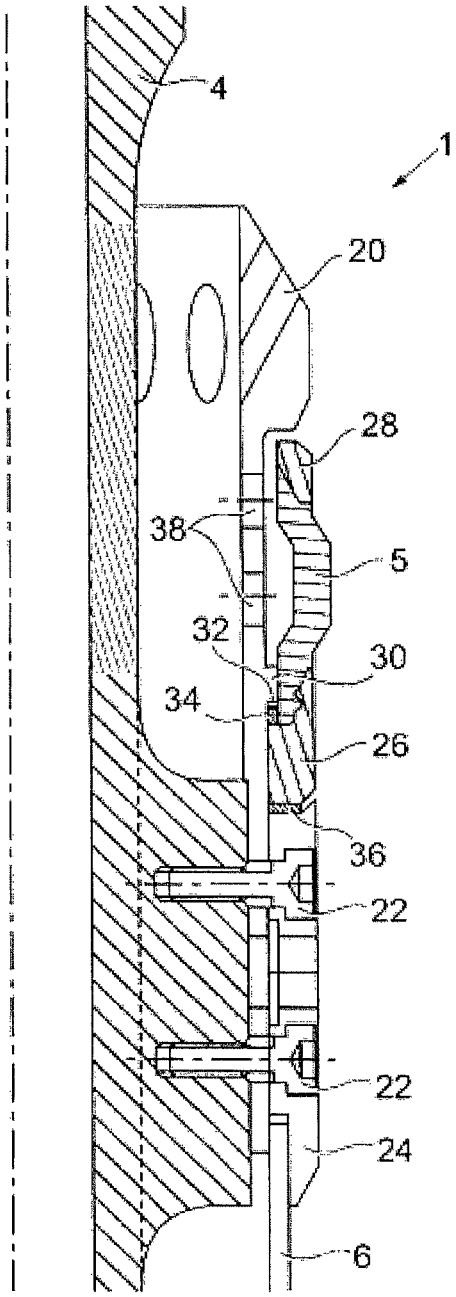
Fig. 2 PRIOR ART
FIG. 2 shows a sectional view of an upper end of the cleaning tool of FIG. 1, with additional detail.
Figure 3:
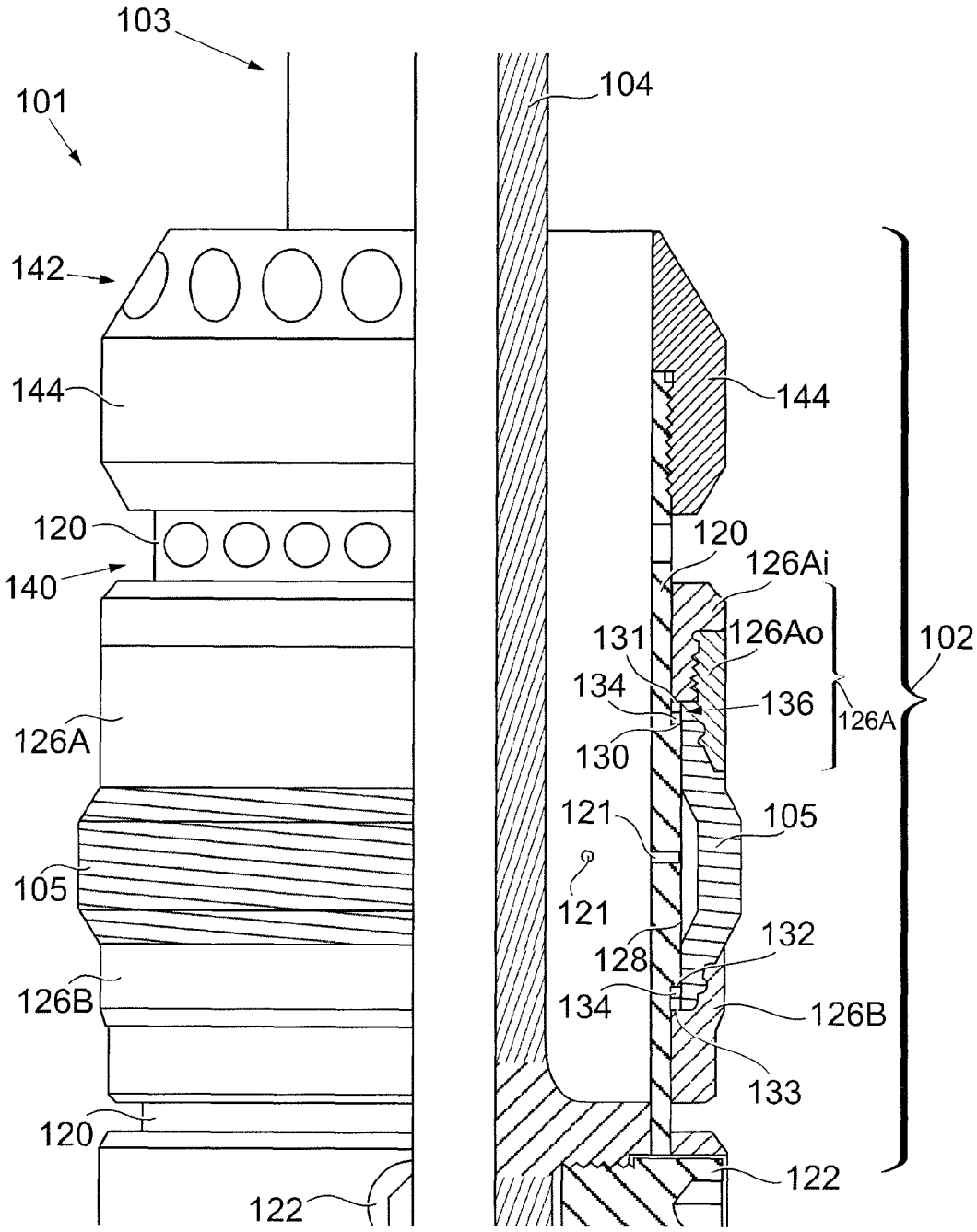
FIG. 3 shows an upper end of a cleaning tool according to an embodiment of the present invention in a "Run in hole" (RIH) position, the left hand side being a side view and the right hand side being a cross-sectional view.

Referring to FIG. 3, this shows an upper end of a cleaning tool 101, which, in all other respects except as illustrated in FIG. 3, is the same as the cleaning tool 1 shown in FIG. 1 and described above.

The cleaning tool 101 includes a diverter cup assembly 102 which includes a tubular body 120 having attachment means in the form of screws 122 (only one shown) for attaching the tubular body 120 to a mandrel 104 of a downhole string 103.

The diverter cup assembly 102 also includes a diverter cup 105, which is a resilient swab cup.

The diverter cup 105 is located concentrically around the tubular body 120 and has an arcuate form, with a larger outer diameter at its centre compared to its upper and lower ends, which are seated on the tubular body 120. The diverter cup 105 has an approximately equal thickness throughout.

The tubular body 120 includes at least one aperture 121 located behind the arc of the diverter cup 105, to allow deformation of the diverter cup 105, since any fluid/air underneath the arc of the diverter cup 105 is not trapped there.

The diverter cup assembly 102 also includes a diverter cup housing 126 comprising upper and lower parts 126A, 126B. The upper and lower parts 126A, 126B are located concentrically around the tubular body 120, and have an inner diameter matching the local outer diameter of the tubular body 120. The upper and lower parts 126A, 126B also have extension portions which overlie the upper and lower ends of the diverter cup 105, keeping the ends of the diverter cup 105 in contact with the tubular body 120 to retain the upper and lower ends of the diverter cup 105 on the tubular body 120. The diverter cup 105 and the upper and lower parts 126A, 126B of the diverter cup housing 126 have co-operating ridges and valleys which push fit (interference fit) together, so that the diverter cup 105 is held firmly in the diverter cup housing 126.

The lower part 126B of the diverter cup housing 126 is one piece. However, the upper part 126A is itself formed in two parts: an inner part 126Ai which contacts the tubular body 120 and an outer part 126Ao, which forms the extension portion that overlies the upper end of the diverter cup 105. The inner part 126Ai and the outer part 126Ao are releasably fitted together e.g. by means of correspondingly threaded parts.

The diverter cup 105 is mounted on the tubular body 120 at an increased diameter portion 128 thereof. The length of the increased diameter portion 128 is nearly equal to the axial height (distance between upper and lower ends) of the diverter cup 105.

The increased diameter portion 128 defines a shoulder at each end thereof, the shoulders providing upper and lower limit stops 130, 132.

The upper part 126A of the diverter cup housing 126 co-operates with an outer face of the tubular body 120 at a location above the upper limit stop 130 and the lower part 126B of the diverter cup housing 126 co-operates with an outer face of the tubular body 120 at a location below the lower limit stop 132.

The upper part 126A of the diverter cup housing 126 has a downwards-facing abutting face 131 configured to engage the upper stop limit 130. Likewise, the lower part 126B of the diverter cup housing 126 has an upwards-facing abutting face 133 configured to engage the lower stop limit 132.

The axial distance between the two abutting faces 131, 133 of the diverter cup housing 126 is sufficiently greater than the axial distance between the two limit stops 130,132 to include space for a bearing 134 between each abutting face and its limit stop and also an additional gap 136. Hence, the abutting faces 131,133 engage their respective upper and lower stop limits 130,132 indirectly, via a respective bearing 134.

The diverter cup housing 126 and the diverter cup 105 are slidably mounted on the tubular body 120 between the upper and lower limit stops 130, 132, the gap 136 allowing the sliding movement. Due to the gap 136, only one of the abutting faces 131, 133 engages its respective stop limit 130, 132 at each extreme sliding position, the gap 136 being present between the other of the abutting faces 131, 133 and its respective stop limit 130, 132.

The tool 101 also includes two rows of ports 140, 142 for passage of fluid into an annulus between the tubular body 120 and the mandrel 104 of the downhole string 103.

A lower row of ports 140 is provided in an upper end of the tubular body 120.

An upper row of ports 142 is provided on a separate member 144 that is configured to connect securably to the upper end of the tubular body 120. In this embodiment, the connection is achieved by way of a left handed thread in cooperating surfaces of the member 144 and the tubular body 120.

The separate member 144 is a protective member, having a maximum outer diameter that is less than the maximum outer diameter of the diverter cup 105, but greater than the maximum outer diameter of the diverter cup housing 126. Hence, the separate member 144 protects the diverter cup housing 126 from damage via contact with the interior bore of the well bore tubulars being cleaned.

Figure 4:
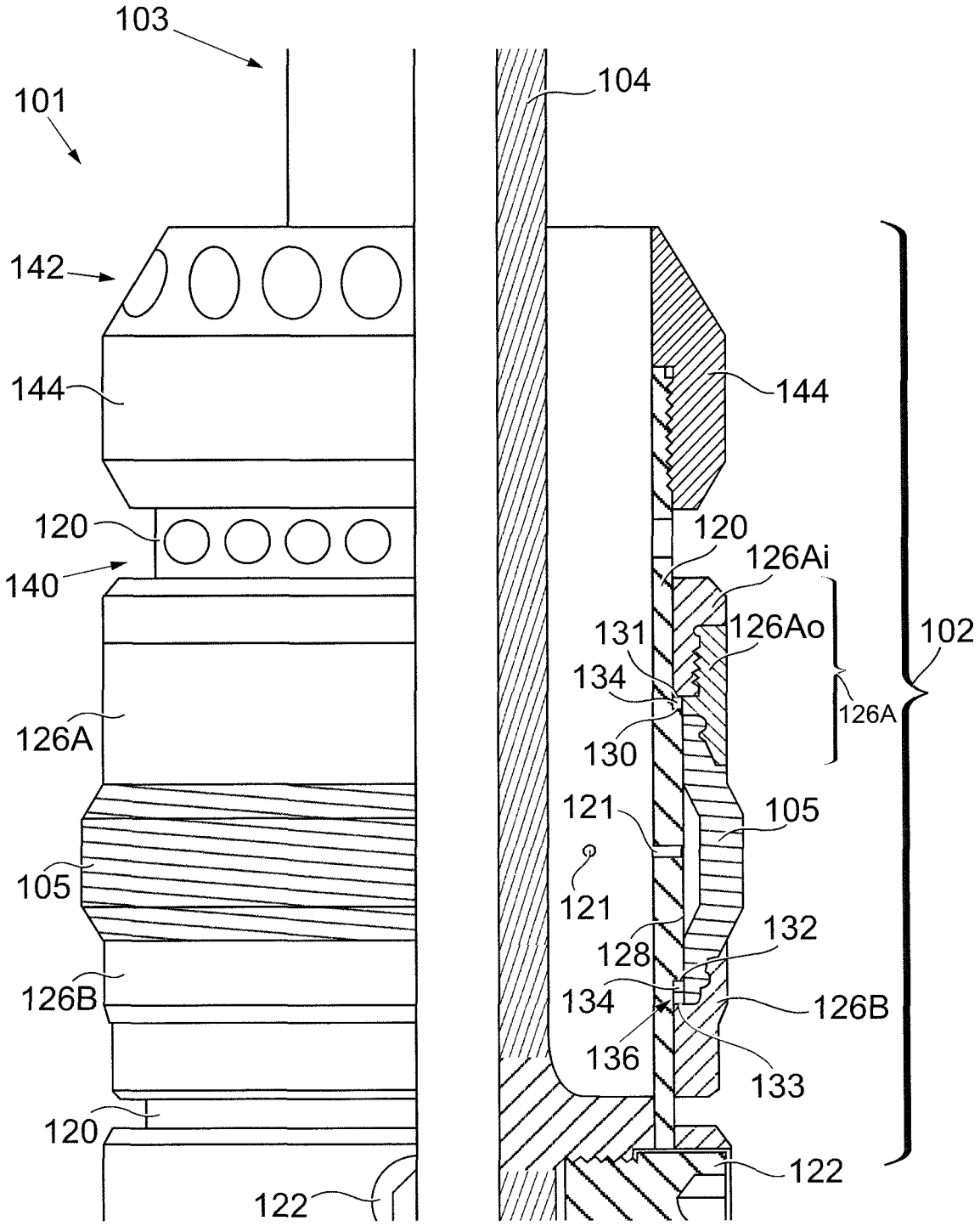
FIG. 4 shows a view corresponding to FIG. 3, with the cleaning tool in a "Pull out of hole" (POH) position.

As above, FIGS. 3 and 4 only show the upper end of the cleaning tool 101, the rest of which is shown in FIG. 1. Hence, the diverter cup assembly (105, 120, 126) forms part of the cleaning tool 101. The cleaning tool 101 includes a cleaning tool body and diversion means for diverting well fluid passing the tool 101 through the cleaning tool body. The diversion means are provided by the inlet ports 140, 142, bores 8 in the body, and the chamber 9. The cleaning tool 101 also includes a filtration means (filter 6) for filtering debris particles from at least some of the well fluid. The filter 6 may typically be a wire screen sized to prevent particles of a predetermined size from passing therethrough.

The downhole string 103 may be a pipe string, coiled tubing, a wire line, or other kinds of downhole string.

The use of the diverter cup assembly will now be explained with reference to FIGS. 3 and 4.

FIG. 3 shows the configuration adopted when the downhole string 103 is being run in hole (RIH).

In use, when being run in hole, the downhole string 103 moves downwards relative to the diverter cup housing 126 and the diverter cup 105, which slide upwards as far as the position shown in FIG. 3. Hence, the tool 101 is automatically brought into the configuration of FIG. 3 by merely running in hole, with no need for manual activation.

In FIG. 3, the diverter cup housing 126 and the diverter cup 105 are at their extreme uppermost position relative to the tubular body 120, with the lower abutting face 133 pressing on the bearing 134, which is pressing on the lower limit stop 132. Hence, the diverter cup housing 126 and diverter cup 105 cannot slide any further upwards relative to the tubular body 120. In this position, the gap 136 is at the upper end, between the bearing 134 and the upper abutting face 131.

After the FIG. 3 position has been reached, further downwards movement of the downhole string 103 "pulls" the diverter cup 105 into the hole via its lower end. That is, the lower part 126B of the diverter cup housing 126 receives a downwards force from the lower limit stop 132 via the bearing 134. The lower part 1268 moving downwards pulls on the lower end of the diverter cup 105. There is no corresponding pushing of the trailing upper end of the diverter cup 105, because the gap 136 is adjacent the upper part 126A of the diverter cup housing. Hence, the diverter cup 105 does not squat or shorten. Instead, the diverter cup 105 can stretch/elongate upwards, increasing the gap 136, thereby protecting the diverter cup 105 from damage by avoiding catching or snagging on any ledges in the well.

Hence, the lower limit stop 132 is configured to engage the lower part 126B of the diverter cup housing 126 when the downhole string 103 is run in hole. More specifically, the lower part of the diverter cup 105 receives a downwards force from the tubular body 120 via the lower limit stop 132 whilst no pushing force is applied to the upper part of the diverter cup. The diverter cup 105 is effectively pulled into the well, and not pushed.

FIG. 4 shows the configuration when the downhole string 103 is being pulled out of the hole (POH).

When being pulled out of the hole, the downhole string 103 moves upwards relative to the diverter cup housing 126 and the diverter cup 105, which slide downwards as far as the position shown in FIG. 4. Hence, the tool 101 is automatically brought into the configuration of FIG. 4 by merely pulling the downhole string 103 out of the hole.

In FIG. 4, the diverter cup housing 126 and the diverter cup 105 are at their extreme lowest position relative to the tubular body 120, with the upper abutting face 131 pressing on the bearing 134, which is pressing on the upper limit stop 131. Hence, the diverter cup housing 126 and diverter cup 105 cannot slide any further downwards relative to the tubular body 120. In this position, the gap 136 is at the lower end, between the bearing 134 and the lower abutting face 133.

After the FIG. 4 position has been reached, further upwards movement of the downhole string 103 pulls the diverter cup 105 out of the hole via its upper end. That is, the upper part 126A of the diverter cup housing 126 receives an upwards force from the upper limit stop 130 via the bearing 134. The upper part 126A moving upwards pulls on the upper end of the diverter cup 105. There is no corresponding pushing of the lower end of the diverter cup 105, because the gap 136 is adjacent the trailing lower part 126B of the diverter cup housing 126. Hence, the diverter cup 105 does not squat or shorten. Instead, the diverter cup 105 can stretch/elongate downwards, increasing the gap 136, thereby protecting the diverter cup 105 from damage.

Hence, the upper limit stop 130 is configured to engage the upper part 126A of the diverter cup housing 126 when the downhole string 103 is being pulled out of the well. More specifically, the upper part of the diverter cup 105 receives an upwards force from the tubular body 120 via the upper limit stop 130 whilst no pushing force is applied to the lower part of the diverter cup. The diverter cup 105 is effectively pulled out of the well, and not pushed. In this way whenever the tool is reciprocated upon the string (during RIH or POH), the diverter cup is always pulled and not pushed.

Modifications and improvements can be incorporated without departing from the scope of the invention. For example, some embodiments may not require any bearings 134. In such cases, the increased diameter portion 128 may be longer relative to the distance between the abutting faces 131, 133.

The invention claimed is:

1. An assembly comprising:

a tubular body attached to a downhole string;

a diverter cup; and a diverter cup housing comprising upper and lower parts which retain the upper and lower ends of the diverter cup respectively, the diverter cup housing and the diverter cup being located concentrically around the tubular body and being slidably mounted on the tubular body between upper and lower limit stops, wherein, in use in a well, the lower limit stop engages the lower part of the diverter cup housing, via a first bearing, when the downhole string is being run into the well, and the upper limit stop engages the upper part of the diverter cup housing, via a second bearing, when the downhole string is being pulled out of the well.

2. The assembly as claimed in claim 1, wherein the tubular body has an increased diameter portion defining a shoulder at each end thereof, the shoulders providing the upper and lower limit stops.

3. The assembly as claimed in claim 1, wherein the upper part of the diverter cup housing co-operates with an outer face of the tubular body at a location above the upper limit stop and wherein the lower part of the diverter cup housing co-operates with an outer face of the tubular body at a location below the lower limit stop.

4. The assembly as claimed in claim 1, wherein the upper part of the diverter cup housing has a downwards-facing abutting face engaged with the upper stop limit.

5. The assembly as claimed in claim 4, wherein the lower part of the diverter cup housing has an upwards-facing abutting face engaged with the lower stop limit.

6. The assembly as claimed in claim 5, wherein the axial distance between the two abutting faces of the diverter cup housing is greater than the axial distance between the two limit stops.

7. The assembly as claimed in claim 5, wherein only one of the abutting faces engages its respective bearing at each extreme sliding position, a gap being present between the other of the abutting faces and its respective bearing.

8. The assembly as claimed in claim 1, wherein the diverter cup has a larger diameter at its centre compared to at its upper and lower ends.

9. The assembly as claimed in claim 1, wherein the tubular body includes at least one aperture located behind the diverter cup, to allow deformation of the diverter cup.

10. The assembly as claimed in claim 1, wherein the upper part of the diverter cup housing is assembled in two parts.

11. The assembly as claimed in claim 1, including ports for passage of fluid into an annulus between the tubular body and the downhole string.

12. The assembly as claimed in claim 11, wherein at least some of the ports are provided in an upper end of the tubular body.

13. The assembly as claimed in claim 11, wherein at least some of the ports are provided on a separate member that connects to an upper end of the tubular body.

14. The assembly as claimed in claim 13, wherein the separate member is a protective member, having a maximum outer diameter that is less than the maximum outer diameter of the diverter cup, but greater than the maximum outer diameter of the diverter cup housing.

15. A downhole string comprising a diverter cup assembly, the diverter cup assembly comprising:

a tubular body attached to a downhole string;

a diverter cup;

a diverter cup housing comprising upper and lower parts which retain the upper and lower ends of the diverter cup respectively, the diverter cup housing and the diverter cup being located concentrically around the tubular body and being slidably mounted on the tubular body between upper and lower limit stops, wherein, in use in a well, the lower limit stop engages the lower part of the diverter cup housing when the downhole string is being run into the well, and the upper limit stop engages the upper part of the diverter cup housing when the downhole string is being pulled out of the well;

a separate member connected to an upper end of the tubular body, the separate member having a maximum outer diameter that is less than a maximum outer diameter of the diverter cup and greater than a maximum outer diameter of the diverter cup housing; and a port on the separate member for passage of fluid into an annulus between the tubular body and the downhole string.

16. The downhole string as claimed in claim 15, wherein the downhole string comprises a cleaning tool for cleaning the interior bore of well bore tubulars, and wherein the diverter cup assembly forms part of the cleaning tool.

17. The downhole string as claimed in claim 16, wherein the cleaning tool comprises a cleaning tool body, a diversion member that diverts well fluid passing the tool through the cleaning tool body, and a filter that filters debris particles from at least some of the well fluid.

18. An apparatus comprising a tubular body attached to a downhole string;

a diverter cup assembly slidably mounted upon the tubular body and positioned between predetermined first and second limit stops provided upon the tubular body, a diverter cup comprising a flexible material of a length having a first end and a second end; and a diverter cup housing comprising first and second parts which retain the first and second ends of the diverter cup respectively, the respective first and second parts of the diverter cup housing engaged with corresponding first and second limit stops, via a respective bearing, one at a time according to a direction of movement established by normal reciprocation of the tool in use, such that whenever the tool is reciprocated upon a workstring during run-in or pull-out, the diverter cup is always pulled and not pushed.

19. The apparatus of claim 18, wherein the first limit stop is a lower limit stop that engages the first part of the diverter cup housing, the first part being a lower part of the diverter cup housing, when the downhole string is run in hole.

20. The apparatus of claim 18, wherein the second limit stop is an upper limit stop that engages the second part of the diverter cup housing, the second part being an upper part of the diverter cup housing, when the downhole string is pulled out of a well.

* * * * *